United States Patent [19]

Annoot

[11] 4,445,741

[45] May 1, 1984

[54] DOUBLE-PLUG SEISMIC CONNECTOR

[75] Inventor: Ira R. Annoot, Pasadena, Tex.

[73] Assignee: Houston Geophysical Products, Inc., Houston, Tex.

[21] Appl. No.: 310,387

[22] Filed: Oct. 13, 1981

[51] Int. Cl.[3] ..... H01R 19/56

[52] U.S. Cl. ..... 339/49 R; 339/105; 339/166 R

[58] Field of Search ..... 339/28, 29 R, 47 R, 339/49 R, 103 R, 105, 166 R, 218 R, 218 M

[56] References Cited

U.S. PATENT DOCUMENTS

| | | | |
|---|---|---|---|
| 877,383 | 1/1908 | Swan | 339/105 |
| 995,674 | 6/1911 | Hertzberg et al. | 339/49 R |
| 2,279,341 | 4/1942 | Powell | 339/166 R |
| 3,093,434 | 6/1963 | Francis | 339/218 R |
| 3,493,915 | 2/1970 | Cox | 339/166 R |
| 3,907,393 | 9/1975 | Ludwig | 339/47 R |
| 3,953,099 | 4/1976 | Wilson | 339/60 M |
| 3,956,575 | 5/1976 | Sutherland | 339/103 R |

FOREIGN PATENT DOCUMENTS

| | | | |
|---|---|---|---|
| 362766 | 10/1922 | Fed. Rep. of Germany | 339/166 R |
| 495193 | 4/1930 | Fed. Rep. of Germany | 339/105 |
| 802822 | 2/1951 | Fed. Rep. of Germany | 339/166 R |
| 769973 | 6/1934 | France | 339/105 |
| 254836 | 7/1926 | United Kingdom | 339/45 R |
| 275225 | 11/1927 | United Kingdom | 339/166 R |

*Primary Examiner*—John McQuade
*Assistant Examiner*—Gary F. Paumen
*Attorney, Agent, or Firm*—Michael P. Breston

[57] ABSTRACT

The double-plug seismic electric connector comprises an elongated insulating body. A male connector plug is at one end of the body and a female connector plug is at the opposite end of the body. Each plug has a pair of male and female contacts. A pair of spaced axial conductors is embedded within the insulating body for interconnecting the opposite male and female contacts. The inner end of a double-wire cable is embedded within the insulating body and each wire inner end is connected to one of the conductors.

5 Claims, 10 Drawing Figures

DOUBLE-PLUG SEISMIC CONNECTOR

BACKGROUND OF THE INVENTION

1. Field of the Invention

This invention relates to the art of geophone stringing and more particularly to a double-plug seismic connector or takeout clip having a cable adapted to connect a geophone across the male and female contacts in each plug of the connector.

2. Description of the Prior Art

In seismic prospecting, whether on dry lands or marsh and swamp areas, "spread" cables are used to interconnect "strings" of geophones to seismic recording instruments. Each string has one or more single-plug connectors with "leader" cables that connect two or more geophones. The leader cables have T-couplers for making electric junctions therealong. The geophone strings are connected to a connector coupled to a pair of conductor wires in the multi-wire spread cable.

The geophones are electrically interconnected with leader cables at spaced intervals in various networks consisting of series and parallel combinations. The process of interconnecting geophones is commonly referred to as "stringing". The art of geophone stringing has been plagued with numerous problems which are described, for example, in U.S. Pat. No. 3,956,575. This patent relates to a hybrid seismic takeout clip which has exposed takeout contacts.

In one prior art stringing method, single-plug connectors and T-type couplers are used for interconnecting geophones and leader cables. One type of commercially known T-coupler is a completely molded T around the leader cables' junction; another type is a fastened T formed from two members which are clamped together around the junction, and then the inside of the T is filled with a suitable potting compound. Both known T-couplers provide a waterproof junction, but the molded T is impossible to repair in the field because the seismic crew has no injection molding equipment, while the fastened T requires considerable skill and time to first dismantle and remove the potting compound and then to reassemble and to reshoot the compound into the T.

Another type coupler for joining three leader cables is disclosed in said U.S. Pat. No. 3,956,575 which requires no potting compounds. This coupler is still labor-intensive and is also prone to human error. Such errors are normally not detected until final checkout is made on the assembled geophone strings. When a defective geophone string is found, it is very time-consuming to locate the origin of the trouble which frequently lies in erroneous inter-wire connections.

In addition to the problems encountered while stringing the geophones in the place of manufacture of the geophones and the geophone strings, problems also exist in the field while using the geophone strings. Thus, T-couplers become frequently damaged by physical objects and their outer jackets and housings may be eaten up by rodents, or they become damaged by rough handling. If trouble shooting is very time-consuming or costly, sometimes a very expensive entire geophone string may have to be discarded because the fault cannot be easily located and may lie in a T-coupler.

It is a main object of the present invention to overcome the above-mentioned drawbacks of the known geophone stringing art and to provide a method and means for stringing geophones without the use of couplers. The invention reduces considerably the amount of labor required and hence the cost of stringing geophones.

It is a further object of the present invention to reduce, as much as possible, the possibility of human error in the assembly and the subsequent trouble shooting of the geophone strings.

SUMMARY OF THE INVENTION

The double-plug seismic electric connector or clip comprises an elongated insulating body. A male connector plug is at one end of the body and a female connector plug is at the opposite end of the body. The female plug has a sleeve for captivating a cooperable male plug of another double-plug connector. Each plug has a pair of male and female contacts. A pair of spaced axial conductors is embedded within the insulating body. Each conductor establishes a conductive path between the male contact in each one of the plugs and the female contact in the opposite plug.

There is preferably provided a cable having a pair of conductor wires. The inner end of the cable is embedded within the insulating body and each wire inner end is connected to one of the conductors. The outer end of the cable extends outwardly of the body of the connector.

In one embodiment, each conductor is a tubular member having at one end an axial bore forming the female contact and at its opposite end having a threaded axial bore for threadedly accepting the male contact. An insulating support is embedded in the body. The support has a pair of axial bores, and each bore accepts a conductor therethrough. The support has another two pairs of auxiliary axial bores. Each pair of auxiliary bores accepts therethrough for anchoring the inner end of one of the wires in the cable.

BRIEF DESCRIPTION OF THE DRAWINGS

in FIG. 6 the leader cable exits near the male plug, and in FIG. 6A it exits near the female plug, otherwise the electric connections in both connectors shown in FIGS. 6, 6A are the same;

DETAILED DESCRIPTION OF THE PREFERRED EMBODIMENT

Figure 1:
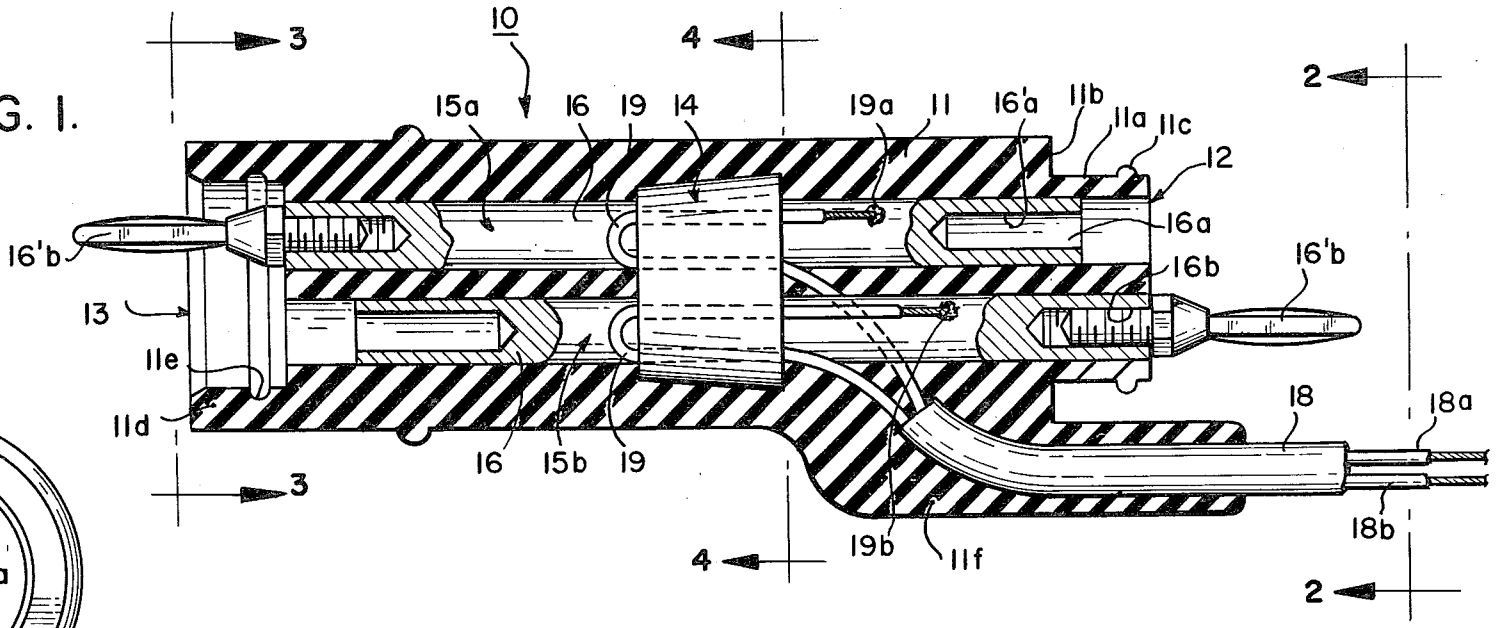
FIG. 1 is a longitudinal sectional view of the double-plug seismic clip of this invention.
Figure 5:
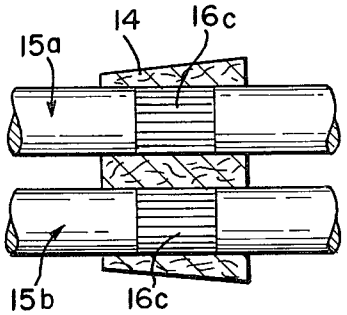
FIG. 5 is a side view of the pair of embedded conductors showing the knurls thereon.
Figure 4:
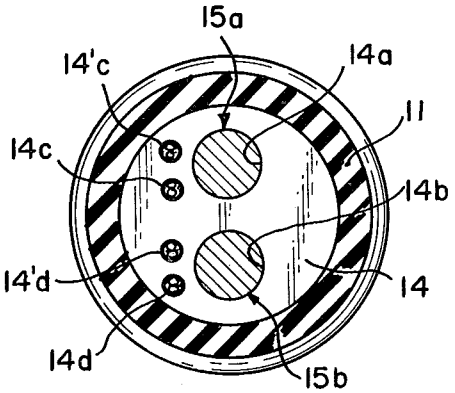
FIGS. 2, 3 and 4 are views taken on lines 2—2, 3—3 and 4—4, respectively, of FIG. 1.
Figure 2:
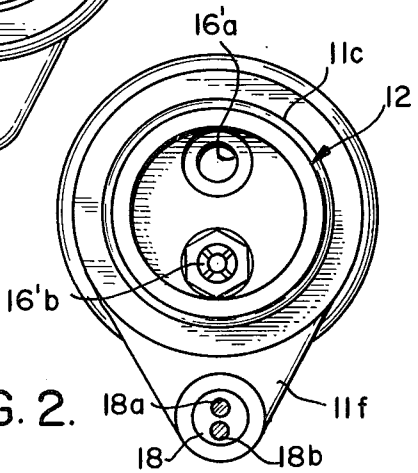
Figure 3:
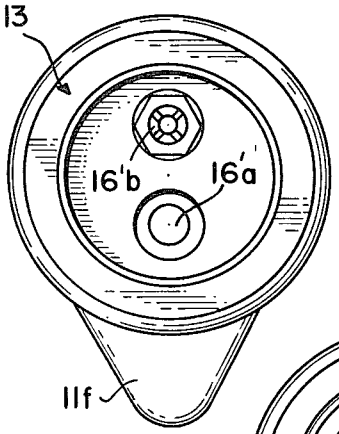
Figure 6:
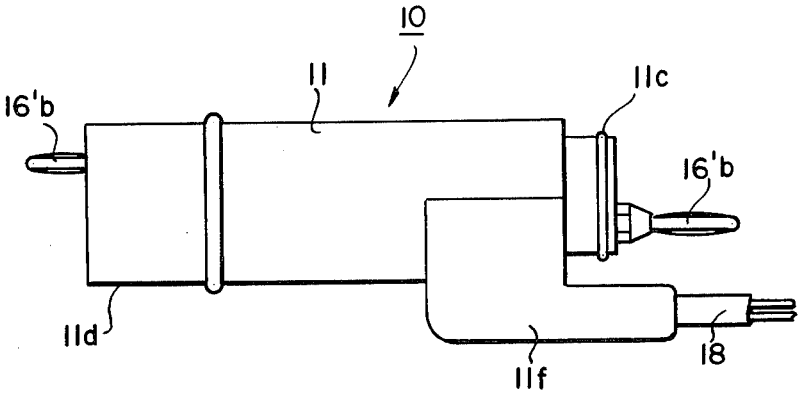
FIGS. 6 and 6A are perspective views of two fully assembled double-plug seismic connectors.
Figure 6A:
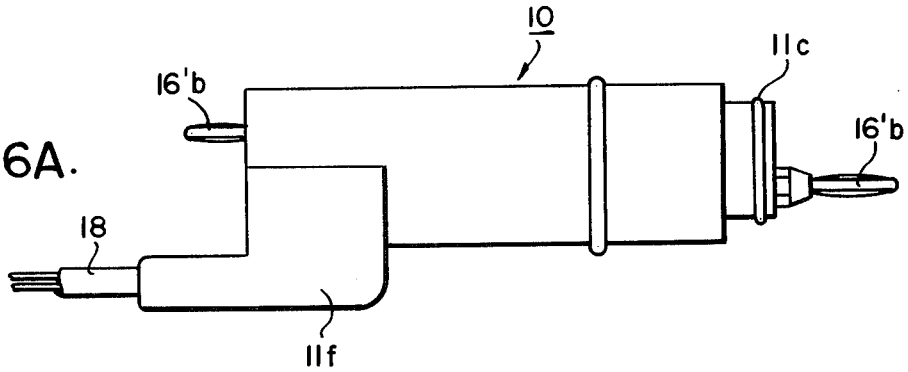

To facilitate the understanding of the specification, throughout the drawings identical or similar parts will be designated, whenever possible, with identical reference characters and sometimes followed by a prime (').

Turning now to FIGS. 1–6, there is shown a double-plug seismic electric takeout connector or clip, generally designated as 10, which comprises an elongated body 11 of generally cylindrical configuration. Body 11 is made of an insulating elastic material such as a neoprene compound 60 Dur. Body 11 carries a pair of connector plugs at the opposite ends thereof: a male plug 12 and a female plug 13.

Embedded inside body 11 is a frusto-conical support 14 preferably made of a rigid block of insulating material such as nylon. Support 14 has a pair of spaced, axial bores 14*a*, 14*b* (FIG. 4), an auxiliary pair of axial bores of smaller diameter 14*c*, 14'*c*, and another auxiliary pair of axial bores of smaller diameter 14*d*, 14'*d*.

Securely mounted inside bore 14*a* is a first electric conductor means 15*a*. Securely mounted inside bore 14*b* is a second electric conductor means 15*b*. Each conductor means is preferably made of a solid brass tube 16. Tubes 16 are of equal length but are axially displaced from each other (FIG. 5) by about 0.65 cm. One end of tube 16 (FIGS. 2, 3) is provided with an unthreaded bore 16*a*, and the opposite end is provided with a threaded bore 16*b*. Approximately midway between bores 16*a*, 16*b* are provided knurls 16*c* which serve to anchor each tube 16 to the support 14. The inner wall of bore 16*a* forms a female contact 16'*a* for accepting therein a male connector part, such as a "banana" pin 16'*b* (FIG. 6), of an adjacent mating cooperable connector plug. Bore 16*b* threadedly receives the inner portion of pin 16'*b*. As thus far described, the construction of the conductors 15*a* and 15*b* is symmetrical relative to a bisecting vertical plane.

Figure 9:
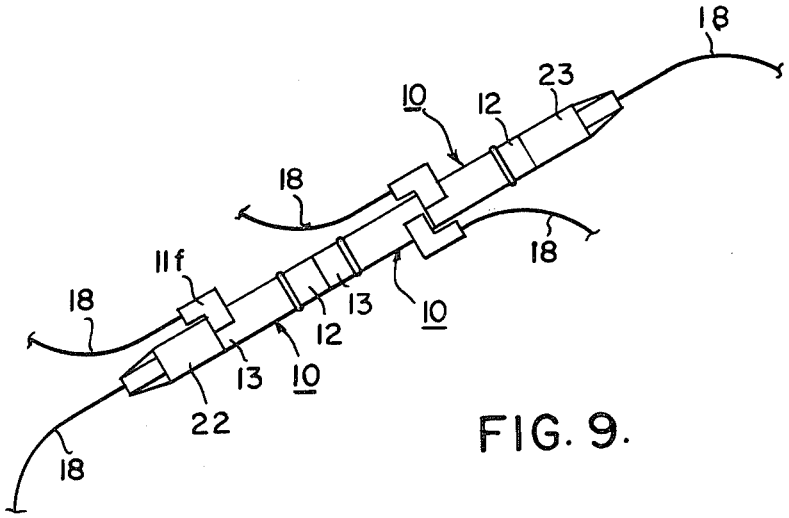
FIG. 9 shows a plurality of double-plug seismic connectors interconnected with a pair of prior art single-plug connectors for stringing geophones to the cables protruding outwardly of the double-plug connectors.

The right-ended side (as viewed in FIG. 1) of body 11 has a reduced diameter portion 11*a* defining a shoulder 11*b* and an O-ring 11*c*. The left-end side of body 11 defines a cylindrical sleeve portion 11*d* having in the center thereof an annular groove 11*e* for accepting the O-ring 11*c* of a mating adjacent male plug 12 (FIG. 9). Sleeve 11*d* of an adjacent female plug 13 fits over and captures male plug 12. When a pair of male and female plugs 12 and 13 become matingly engaged, pin 16'*b* of each mating plug makes electric contact with the female contact 16'*a* in the other mating connector plug.

Also embedded in an extension 11*f* of body 11 is a leader cable 18 having a pair of insulated conductor wires 18*a*, 18*b*. The inner end of wire 18*a* passes through auxiliary bores 14*c*, 14'*c* in opposite axial directions so as to form a U-bend 19 with support 14. The free end of wire 18*a* is soldered to conductor 15*a* at point 19*a*. Similarly, wire 18*b* passes through auxiliary bores 14*d*, 14'*d* to form a U-bend 19 and to become soldered at a point 19*b* on conductor 15*b*. In this manner, wires 18*a*, 18*b* are electrically connected to the contacts 16'*a*, 16'*b* of the male and female plugs 12, 13, respectively, and are anchored to support 14 by the U-bends 19 and the soldered joints 19*a*, 19*b*. Body 11 makes the soldered joints 19*a*, 19*b* waterproof, while the wires 18*a*, 18*b* and the conductors 15*a*, 15*b* are anchored to the rigid nylon support 14.

Connector 10 is adapted to become coupled to a female plug and to a male plug at its opposite ends. It also serves as a junction between conductor wires 18*a*, 18*b* and the contacts 16'*a* and 16'*b* in each of plugs 12 and 13.

Figure 7:
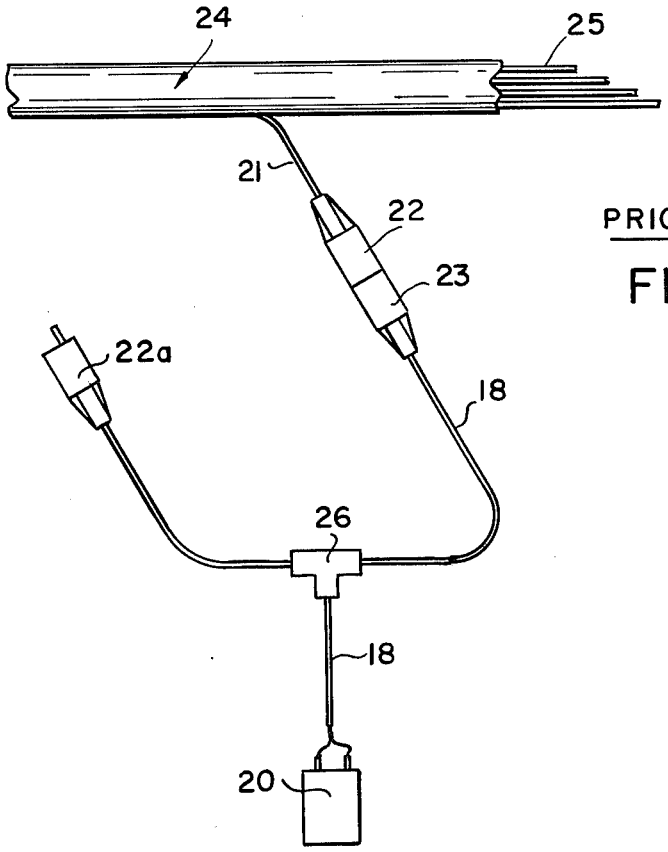
PRIOR ART FIG. 7.
FIG. 7 illustrates a prior art method of connecting a geophone or other such device to the connector of a multiwire spread cable with the use of a T-coupler and a pair of conventional male and female single-plug seismic connectors.

FIG. 7 shows a typical prior art method of stringing geophones 20 (only one is shown for simplicity) to a conventional male plug 22 which is connected to a pair of wires 21 inside a spread cable 24 carrying a plurality of conductors 25. The typical arrangement includes a female single-plug connector 23 which cooperatively engages with a male single-plug connector 22. Utilizing a T-coupler 26, the leader cable 18 connected to female plug 23 is coupled to the leader cable 18 of another male plug 22*a* and to the leader cable 18 connected to geophone 20. In practice, several such T-couplers 26 are employed as described in said U.S. Pat. No. 3,956,575 for making a geophone string which interconnects a plurality of geophones 20. The other connector plug 22*a* connects the geophone string to another string or to a recording instrument.

Figure 8:
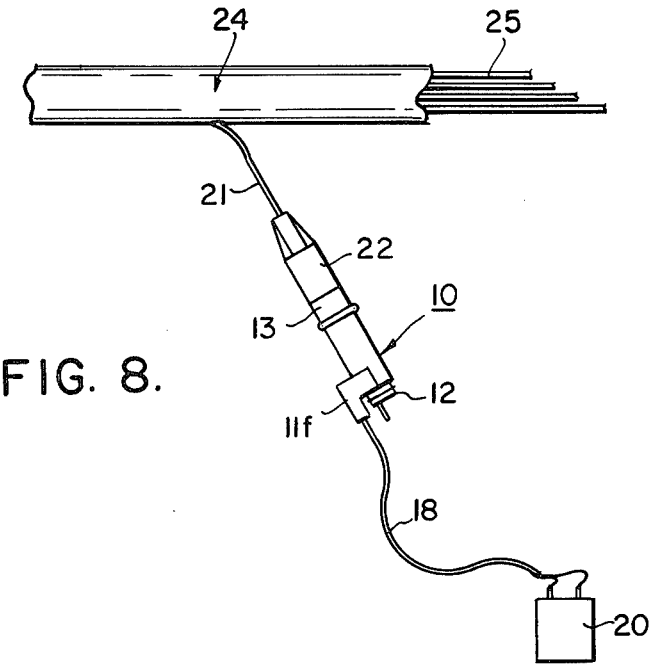
FIG. 8 illustrates for comparison with FIG. 7 the use of a double-plug seismic connector of this invention for connecting the geophone of FIG. 7 with the connector of the spread cable without the use of a T-coupler.

FIG. 8 illustrates how the arrangement shown in FIG. 7, following prior art practice, can be greatly simplified with only a single double-plug connector 10 of this invention. The conventional male plug 22 is connected to the female plug 13 of connector 10. Leader cable 18 forming part of connector 10 is connected to geophone 20 directly instead of through a T-coupler 26 as is required by the prior art arrangement shown in FIG. 7.

FIG. 9 illustrates how a plurality of double-plug connectors 10 of this invention can be interconnected between a conventional male single-plug connector 22 and a conventional female single-plug connector 23. The leader cables 18 are available for direct connection to geophones 20 or to other connectors.

Utilizing the double-plug connectors 10 of this invention, it is possible to interconnect individual geophones 20 in series, parallel, or any combinations thereof. This practice will facilitate the making of the required electrical connections between the conductor wires of the leader cables 18 and the geophones' terminals. It has been found that the soldering of the wires 18*a*, 18*b* of the leader cable 18 to the conductors 15*a*, 15*b* serves a double function: that of making the desired electrical connections, and that of anchoring the conductor wires to the support 14 and to the conductors 15*a*, 15*b*.

As an immediate advantage of this invention, less soldering is required to string the geophones in the place of manufacture of the geophones and of the geophone strings, as well as in the field when repairing the geophone strings.

Thus, a connector 10 of this invention can combine the functions of a pair of prior art male and female single-plug connector plugs 22, 23 (FIGS. 7,8) and of a T-coupler 26. The elimination of the T-couplers avoids a considerable amount of labor as well as human error. As a result, the connectors 10 of this invention are believed to be superior from the standpoint of both cost and reliability.

The above and other advantages, as well as modifications of the preferred embodiment illustrated in the drawings, will readily become apparent to those skilled in the art.

What is claimed is:

1. A double-ended, seismic takeout clip comprising:

an elongated unitary body made of an elastic insulating material;

a solid cylindrical male connector plug, having a pair of electric contacts, projecting outwardly from one end of said body, and an O-ring around the cylindrical body portion of said male plug;

a tubular female connector plug, having a pair of electric contacts, projecting outwardly from the opposite end of said body, and the tubular body portion of the female plug having an inner cylindrical wall defining an annular groove;

said body portions of said male and female plugs being dimensioned to allow, in use, said tubular female plug to snugly accept a male plug of a second like takeout clip, whereby said groove (1) frictionally receives the male plug's O-ring for protecting the interconnected electric contacts of the male and female plugs against moisture penetration and (2) frictionally resists accidental disconnection between said male and female plugs;

a pair of longitudinal electric conductors embedded within said body, each conductor being electrically connected to, for providing a conductive path between, an electric contact in the male plug and an electric contact in the female plug; and a pair of insulated wires, each wire having an inner end whose bare metallic end portion makes an electric connection with one of said conductors, and each wire having an outer end which projects outwardly of said body, whereby the pair of wires which project outwardly of said body are electrically connected across said pair of conductors and thus across the pair of contacts in each plug.

2. A double-ended, seismic takeout clip comprising:

an elongated unitary body made of an elastic insulating material;

a solid cylindrical male connector plug, having a pair of electric contacts, projecting outwardly from one end of said body, and an O-ring around the cylindrical body portion of said male plug;

a tubular female connector plug, having a pair of electric contacts, projecting outwardly from the opposite end of said body, and the tubular body portion of the female plug having an inner cylindrical wall defining an annular groove;

said body portions of said male and female plugs being dimensioned to allow, in use, said tubular female plug to snugly accept a male plug of a second like takeout clip, whereby said groove (1) frictionally receives the male plug's O-ring for protecting the interconnected electric contacts of the male and female plugs against moisture penetration and (2) frictionally resists accidental disconnection between said male and female plugs;

an anchor embedded inside said body;

a pair of laterally-spaced apart longitudinal electric conductors embedded within said body, each conductor being electrically connected to, for providing a conductive path, between an electric contact in the male plug and an electric contact in the female plug; and a pair of insulated wires, each wire having an inner end which is anchored to said anchor and the bare metallic end portion of the wire making an electric connection with one of said conductors, and each wire having an outer end which projects outwardly of said body, whereby the pair of wires which project outwardly of said body are electrically connected across said pair of conductors and thus across the pair of contacts in each plug.

3. A double-ended, seismic takout clip comprising:

an elongated unitary body made of an elastic insulating material;

a solid cylindrical male connector plug, having a pair of electric contacts, projecting outwardly from one end of said body, and an O-ring around the cylindrical body portion of said male plug;

a tubular female connector plug, having a pair of electric contacts, projecting outwardly from the opposite end of said body, and the tubular body portion of the female plug having an inner cylindrical wall defining an annular groove;

said body portions of said male and female plugs being dimensioned to allow, in use, said tubular female plug to snugly accept a male plug of a second like takeout clip, whereby said groove (1) frictionally receives the male plug's O-ring for protecting the interconnected electric contacts of the male and female plugs against moisture penetration, and (2) frictionally resists accidental disconnection between said male and female plugs;

an anchor embedded inside said body, said anchor having a pair of longitudinal bores;

a pair of laterally-spaced apart longitudinal electric conductors embedded within said body, each conductor extending through one of said bores and being electrically connected to, for providing a conductive path between, an electric contact in the male plug and an electric contact in the female plug; and a pair of insulated wires, each wire having an inner end which is anchored to said anchor and the bare metallic end portion of the wire making an electric connection with one of said conductors, and each wire having an outer end which projects outwardly of said body, whereby the pair of wires which project outwardly of said body are electrically connected across said pair of conductors and thus across the pair of contacts in each plug.

4. A double-ended, seismic takeout clip comprising:

an elongated unitary body made of an elastic insulating material;

a solid cylindrical male connector plug, having a pair of electric contacts, projecting outwardly from one end of said body, and an O-ring around the cylindrical body portion of said male plug;

a tubular female connector plug, having a pair of electric contacts, projecting outwardly from the opposite end of said body, and the tubular body portion of the female plug having an inner cylindrical wall defining an annular groove;

said body portions of said male and female plugs being dimensioned to allow, in use, said tubular female plug to snugly accept a male plug of a second like takeout clip, whereby said groove frictionally receives the male plug's O-ring for protecting against moisture penetration into the plugs and disconnection of the plugs;

an anchor embedded inside said body, said anchor having a pair of main longitudinal bores and two pairs of auxiliary longitudinal bores;

a pair of laterally-spaced apart longitudinal electric conductors embedded within said body, each conductor extending through one of said main bores and being connected to, for providing a conductive path between, an electric contact in the male plug and an electric contact in the female plug; and a pair of insulated wires, each wire having an inner end which loops around one pair of said auxiliary bores and the bare metallic end portion of the wire making an electric connection with one of said conductors, and each wire having an outer end which projects outwardly of said body in a waterproof manner, whereby the pair of wires which project outwardly of said body are electrically connected across said pair of conductors and thus across the pair of contacts in each plug, and the interconnected electric contacts of the male and female plugs are sealed against moisture penetration therein.

5. A double-ended, seismic takeout clip comprising:

an elongated unitary body made of an elastic insulating material;

a solid cylindrical male connector plug, having a pair of electric contacts, projecting outwardly from one end of said body;

a tubular female connector plug, having a pair of electric contacts, projecting outwardly from the opposite end of said body;

said female plug having means for frictionally accepting a male plug of a second like takeout clip for protecting against moisture penetration into the plugs and disconnection of the plugs;

a pair of longitudinal electric conductors embedded within said body, each conductor being electrically connected to, for providing a conductive path between, an electric contact in the male plug and an electric contact in the female plug; and a pair of insulated wires, each wire having an inner end whose bare metallic end portion makes an electric connection with one of said conductors, and each wire having an outer end which projects outwardly of said body, whereby the pair of wires which project outwardly of said body are electrically connected across said pair of longitudinal conductors and thus across the pair of contacts in each plug.

* * * * *

REEXAMINATION CERTIFICATE (1483rd)

United States Patent [19]

Annoot

[11] B1 4,445,741

[45] Certificate Issued Jun. 4, 1991

[54] DOUBLE-PLUG SEISMIC CONNECTOR

[75] Inventor: Ira R. Annoot, Pasadena, Tex.

[73] Assignee: Houston Geophysical Products, Inc.

Reexamination Request:
No. 90/001,793, Jun. 20, 1989

Reexamination Certificate for:

| | |
|---|---|
| Patent No.: | **4,445,741** |
| Issued: | **May 1, 1984** |
| Appl. No.: | **310,387** |
| Filed: | **Oct. 13, 1981** |

[51] Int. Cl.[5] ..... H01R 33/88

[52] U.S. Cl. ..... 439/290; 439/284; 439/456; 439/457; 439/651

[58] Field of Search ..... 439/502, 284, 295, 453–455, 439/638, 736, 606

[56] References Cited

U.S. PATENT DOCUMENTS

| | | | |
|---|---|---|---|
| 2,015,590 | 9/1935 | Cavanagh et al. | 439/172 |
| 2,037,630 | 4/1936 | Hudson | 439/281 |
| 3,124,405 | 3/1964 | Massa | 439/282 |
| 3,474,386 | 10/1969 | Link | 439/181 |
| 3,601,761 | 8/1971 | Harris | 439/281 |
| 3,646,499 | 2/1972 | DeLano et al. | 439/281 |
| 3,665,368 | 7/1972 | Ellis | 439/282 |
| 3,693,132 | 9/1972 | Bowen et al. | 439/460 |
| 3,907,395 | 9/1975 | Flanagan | 439/412 |
| 3,960,433 | 6/1976 | Boliver | 439/184 |

FOREIGN PATENT DOCUMENTS 554843 7/1943 United Kingdom .

OTHER PUBLICATIONS

Houston Geophysical Products, Inc. Product Literature, pp. 282–290 and 306–309.

*Primary Examiner*—Gary F. Paumen

[57] ABSTRACT

The double-plug seismic electric connector comprises an elongated insulating body. A male connector plug is at one end of the body and a female connector plug is at the opposite end of the body. Each plug has a pair of male and female contacts. A pair of spaced axial conductors is embedded within the insulating body for interconnecting the opposite male and female contacts. The inner end of a double-wire cable is embedded within the insulating body and each wire inner end is connected to one of the conductors.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2–4 is confirmed.

Claims 1 and 5 are determined to be patentable as amended.

New claims 6, 7, 8 and 9 are added and determined to be patentable.

1. A double-ended, seismic takeout clip comprising:

an elongated unitary body made of an elastic insulating material;

a solid cylindrical male connector plug, having a pair of electric contacts, projecting outwardly from one end of said body, and an O-ring around the cylindrical body portion of said male plug;

a tubular female connector plug, having a pair of electric contacts, projecting outwardly from the opposite end of said body, and the tubular body portion of the female plug having an inner cylindrical wall defining an annular groove;

said body portions of said male and female plugs being dimensioned to allow, in use, said tubular female plug to snugly accept a male plug of a second like takeout clip, whereby said groove (1) frictionally receives the male plug's O-ring for protecting the interconnected electric contacts of the male and female plugs against moisture penetration and (2) frictionally resists accidental disconnection between said male and female plugs;

a pair of longitudinal electric conductors embedded within said body, each conductor being electrically connected to, for providing a conductive path between, an electric contact in the male plug and an electric contact in the female plug; [and]

a pair of insulated wires, each wire having an inner end whose bare metallic end portion makes an electric connection with one of said conductors, and each wire having an outer end which projects outwardly of said body, whereby the pair of wires which project outwardly of said body are electrically connected across said pair of conductors and thus across the pair of contacts in each plug[.]; *and*

*a geophone connected to said outer end of each wire of said pair of insulated wires.*

5. A double-ended, seismic takeout clip comprising;

an elongated unitary body made of an elastic insulating material;

a solid cylindrical male connector plug, having a pair of electric contacts, projecting outwardly from one end of said body;

a tubular female connector plug, having a pair of electric contacts, projecting outwardly from the opposite end of said body;

said female plug having means for frictionally accepting a male plug of a second like takeout clip for protecting against moisture penetration into the plugs and disconnection of the plugs;

a pair of longitudinal electric conductors embedded within said body, each conductor being electrically connected to, for providing a conductive path between, an electric contact in the male plug and an electric contact in the female plug; [and]

*rigid insulating support connected to an supporting said pair of electric conductors, and* a pair of insulated wires, each wire having an inner end whose bare metallic end portion makes an electric cocnection with one of said conductors, and each wire having an outer end which projects outwardly of said body, whereby the pair of wires which project outwardly of said body are electrically connected across said pair of longitudinal conductors and thus across the pair of contacts in each plug.

*6. A double ended seismic takeout clip according to claim 5, wherein said wires are anchored to said support at said inner ends.*

*7. A paralleling double-ended, seismic takeout clip set up comprising:*

*at least a first and a second takeout clip, each comprising;*

*an elongated unitary body made of an elastic insulation material;*

*a solid cylindrical male connector plug, having a pair of electric contacts, projecting outwardly from one end of said body;*

*a tubular female connector plug, having a pair of electric contacts, projecting outwardly from the opposite end of said body;*

*said female plug having means for frictionally accepting a male plug of a second like takeout clip for protecting against moisture penetration into the plug and disconnection of the plugs;*

*a pair of longitudinal electric conductors embedded within said body, each conductor being electrically connected to, for providing a conductive path between, an electric contact in the male plug and an electric contact in the female plug; and*

*a pair of insulated wires, each wire having an inner end whose bare metallic end portion makes an electric connection with one of said conductors, and each wire having an outer end which projects outwardly of said body, whereby the pair of wires which project outwardly of said body are electrically connected across said pair of longitudinal conductors and thus across the pair of contacts in each plug;*

*a geophone connected to an outer end of said pair of insulated wires;*

*wherein said male connector plug of said first takeout clip is connected to a female connector plug of said second takeout clip.*

*8. A paralleling double-ended, seismic takeout clip set up comprising:*

*at least a first and a second takeout clip, each comprising:*

*an elongated unitary body made of an elastic insulation material;*

*a solid cylindrical male connector plug, having a pair of electric contacts, projecting outwardly from one end of said body;*

*a tubular female connector plug, having a pair of electric contacts, projecting outwardly from the opposite end of said body;*

*said female plug having means for frictionally accepting a male plug of a second like takeout clip for protecting against moisture penetration into the plug and disconnection of the plugs;*

*a pair of longitudinal electric conductors embedded within said body, each conductor being electrically connected to, for providing a conductive path between, an electric contact in the male plug and an electric contact in the female plug; and*

*a pair of insulated wires, each wire having an inner end whose bare metallic end portion makes an electric connection with one of said conductors, and each wire having an outer end which project outwardly of said body, whereby the pair of wires which projects outwardly of said body are electrically connected across said pair of longitudinal conductors and thus across the pair of contacts in each plug;*

*a rigid insulating support in said body and supporting said conductors;*

*wherein said male connector plug of said first takeout clip is connected to a female connector plug of said second takeout clip.*

*9. A double-ended, seismic takeout clip comprising:*

*an elongated unitary geophysical connector body made of an elastic insulating material;*

*a solid cylindrical male connector plug, having a pair of electric contacts projecting outwardly from one end of said body;*

*a tubular female connector plug, having a pair of electric contacts, projecting outwardly from the opposite end of said body;*

*said female plug having means for frictionally accepting a male plug of a second like seismic takeout clip configured for protecting against moisture penetration into the plugs and disconnection of the plugs;*

*a pair of longitudinal electric conductors embedded within said body, each conductor being electrically connected to, for providing a conductive path between, an electric contact in the male plug and an electric contact in the female plug;*

*a rigid insulating support having a pair of spaced axial bores, one of said conductors positioned in and supported in one of the bores, and the other conductor positioned in and supported in the other bore, and*

*a geophone lead insulated wire pair, each wire having an inner end whose bare metallic end portion makes an electric connection with one of said conductors, and each wire having an outer end which projects outwardly of said body, whereby the pair of wires which project outwardly of said body are electrically connected across said pair of longitudinal conductors and thus across the pair of contacts in each plug.*

* * * * *